US009243445B2

(12) United States Patent
Beaudoin

(10) Patent No.: US 9,243,445 B2
(45) Date of Patent: Jan. 26, 2016

(54) PROTECTIVE WINDOW SHUTTER

(71) Applicant: Stephen Beaudoin, Neptune City, NJ (US)

(72) Inventor: Stephen Beaudoin, Neptune City, NJ (US)

( * ) Notice: Subject to any disclaimer, the term of this patent is extended or adjusted under 35 U.S.C. 154(b) by 0 days.

(21) Appl. No.: 14/253,255

(22) Filed: Apr. 15, 2014

(65) Prior Publication Data

US 2015/0259973 A1 Sep. 17, 2015

Related U.S. Application Data

(60) Provisional application No. 61/951,573, filed on Mar. 12, 2014.

(51) Int. Cl.

| | |
|---|---|
| ***E06B 7/30*** | (2006.01) |
| ***E06B 9/04*** | (2006.01) |
| ***E06B 9/24*** | (2006.01) |
| ***E06B 7/28*** | (2006.01) |

(52) U.S. Cl.

CPC ... *E06B 7/30* (2013.01); *E06B 7/28* (2013.01); *E06B 9/04* (2013.01); *E06B 9/24* (2013.01)

(58) Field of Classification Search

CPC ..... E06B 7/28; E06B 7/30; E06B 9/04; E06B 9/24

USPC ..... 49/70, 163, 149, 171, 61, 62, 63, 67

See application file for complete search history.

(56) References Cited

U.S. PATENT DOCUMENTS

| | | | | |
|---|---|---|---|---|
| 1,738,539 | A * | 12/1929 | Moss | E06B 7/32 232/1 E |
| 2,434,859 | A * | 1/1948 | McLoughlin | E06B 3/28 160/107 |
| 4,763,444 | A * | 8/1988 | Ritchie | 49/171 |
| 6,308,474 | B1 * | 10/2001 | Wilson | 52/202 |
| 6,865,850 | B1 * | 3/2005 | Campbell | 52/202 |
| 6,871,821 | B2 * | 3/2005 | Takahama | 244/129.5 |
| 8,850,949 | B1 * | 10/2014 | Lopez | 89/36.04 |
| 2004/0050507 | A1 * | 3/2004 | Thomas | 160/368.1 |
| 2007/0194187 | A1 * | 8/2007 | Amron | 248/206.5 |
| 2008/0086952 | A1 * | 4/2008 | Holwick | 52/3 |
| 2008/0263958 | A1 * | 10/2008 | Edson | 49/56 |
| 2009/0313902 | A1 * | 12/2009 | Brisbois et al. | 49/460 |
| 2010/0155001 | A1 * | 6/2010 | Bolton | 160/368.1 |

FOREIGN PATENT DOCUMENTS

| | | | | |
|---|---|---|---|---|
| GB | 2442529 | A * | 4/2008 | E06B 7/28 |
| GB | 2480099 | A * | 11/2011 | |

* cited by examiner

*Primary Examiner* — Katherine Mitchell
*Assistant Examiner* — Marcus Menezes
(74) *Attorney, Agent, or Firm* — Stuart M. Goldstein

(57) ABSTRACT

A protective window shutter is designed to cover and uncover a door mounted "peek through" metal framed window. The shutter is made up of two shutter sections, rotatable in relation to each other. The first shutter section is secured adjacent to the window's metal frame and the second shutter section is rotatable from a first position in which the two sections are folded on each other, to a second position in which the second section is extended out from the first section, over the window. The shutter sections are maintained in the closed position by the attraction of metal strike plates on the first shutter section and corresponding magnets encased within the second shutter. The second section is maintained over the window by the attraction of the magnets to the window's metal framing. The shutter sections are made of high strength, lightweight PVC or like material.

7 Claims, 5 Drawing Sheets

PROTECTIVE WINDOW SHUTTER

RELATED APPLICATION

The herein application claims the benefit of provisional application Ser. No. 61/951,573, filed on Mar. 12, 2014.

BACKGROUND OF THE INVENTION

There are many types of shutters designed to cover windows for a variety of purposes. For instance, shutters are routinely utilized for privacy, security, esthetics, control of room lighting, etc. One such purpose which has become increasingly important in today's society is the need to close of "peek through" windows mounted within doors in classrooms, offices, or other interior doors, to ensure safety, privacy, and added security to students, teachers, and others occupying a room. There is a need especially to quickly and efficiently close a shutter over a door mounted window for the safety of educators and students in schools and similar buildings. This capability has value, as well, in other buildings and environments where security and safety are important. While many different types of shutters exist, there are none which can be put in place quickly and efficiently to cover a door mounted window.

SUMMARY OF THE INVENTION

It is thus the object of the present invention to provide a protective window shutter which has significant advantages over existing shutters.

It is the object of the present invention to provide a unique protective window shutter which addresses the concerns of students, teachers, educators, and others who seek to obtain an element of privacy, security and safety within rooms.

It is a further object of the present invention to provide a protective window shutter which is lightweight, and easy and readily installed on doors having "peek through" windows.

It is a further object of the present invention to provide a protective window shutter which remains unobtrusively in place adjacent to an uncovered window mounted in a door.

It is still another object of the present invention to provide a protective window shutter which is quickly and easily closed to fully cover the window, and then easily returned to the uncovered position adjacent to the window.

It is another object of the present invention to provide a protective window shutter which is made of a high strength, yet lightweight material, capable of functioning properly while still withstanding impact by students or sports equipment in a gymnasium environment.

These and other objects are accomplished by the present invention, a lightweight foldable protective window shutter and shutter system for covering and uncovering a door mounted "peek through" metal framed window which comprises two interconnected shutter sections, rotatable in relation to each other. The first shutter section is secured adjacent to the metal frame of the window and the second shutter section is rotatable from a first closed position in which the two sections are folded on each other, to a second position in which the second section is extended out from the first section, over the window. The shutter sections are maintained in the closed position by the attraction of metal strike plates on the first shutter section and corresponding magnets encased within the second shutter. The second section is maintained over the window by the attraction of the magnets to the metal framing around the window. The shutter sections are made of high strength, yet lightweight PVC or like material, capable of withstanding routine impacts.

DESCRIPTION OF THE INVENTION

Figure 1:
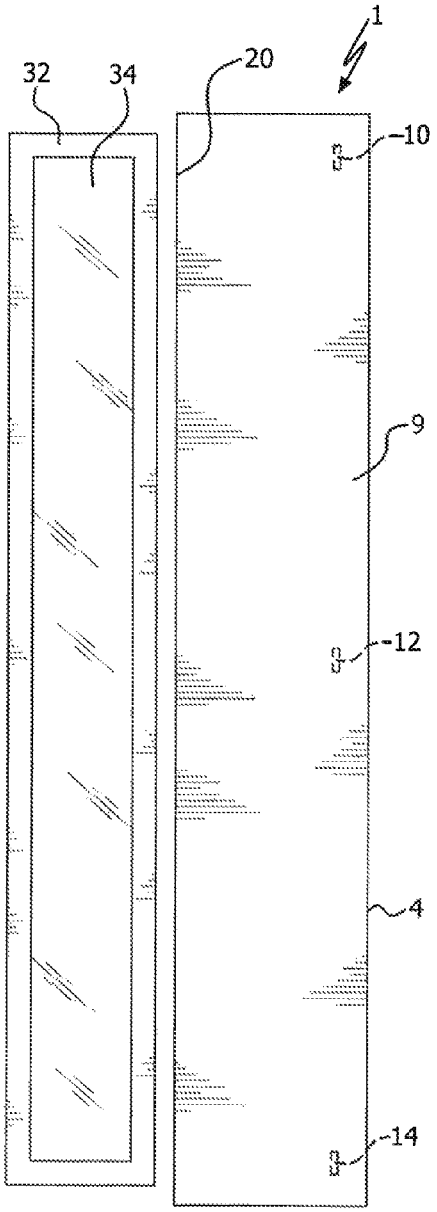
FIG. 1 shows the protective window shutter in the window uncovered position, adjacent to a metal framed window.
Figure 2:
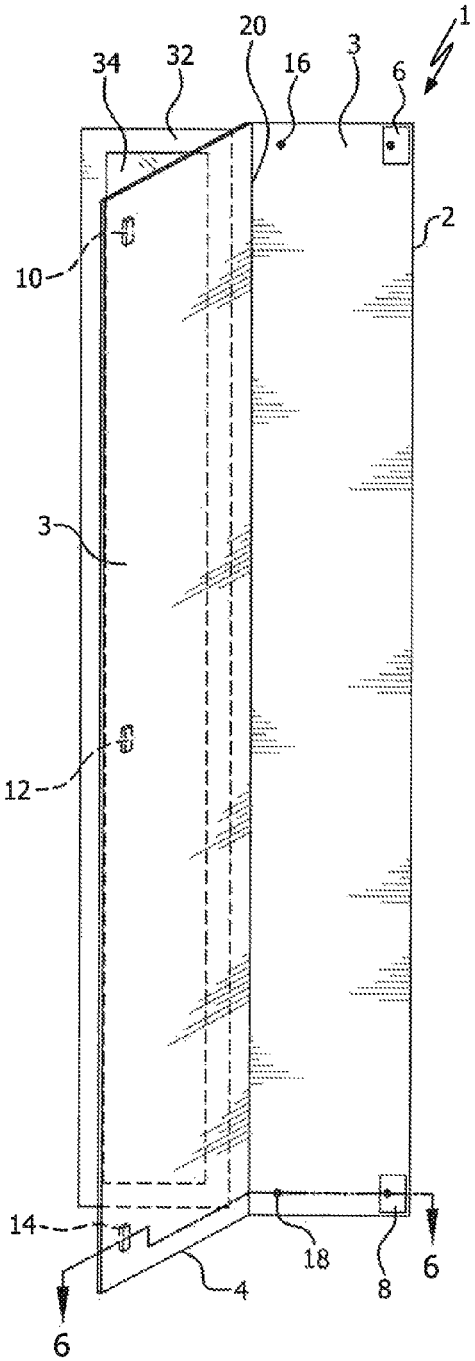
FIG. 2 shows the protective window shutter illustrating the process of covering the window.

Protective window shutter 1 comprises first elongated shutter section 2 and second elongated shutter section 4. First section 2 has an elongated top layer comprising sheet 3 of high impact, corrugated or equivalent PVC or like lightweight material and a second elongated bottom layer comprising sheet 5 made of the same material. Sheets 3 and 5 extend the full length of section 2 and are separated by a narrow space in which elongated, corrugated PVC strength ribs 7 extend the length of the section. Metal strike plates 6 and 8 are secured at the top and bottom ends of top sheet 3 of first section 2.

Second section 4, made of the same material as first section 2, is positioned adjacent to the first section and is formed with the same elongated top sheet 3 as the first section. This top sheet 3 extends the full width of shutter 1, from the outboard edge of first section 2 to the outboard edge of second section 4, and the full length of both sections, from their top edges to their bottom edges.

Figure 5:
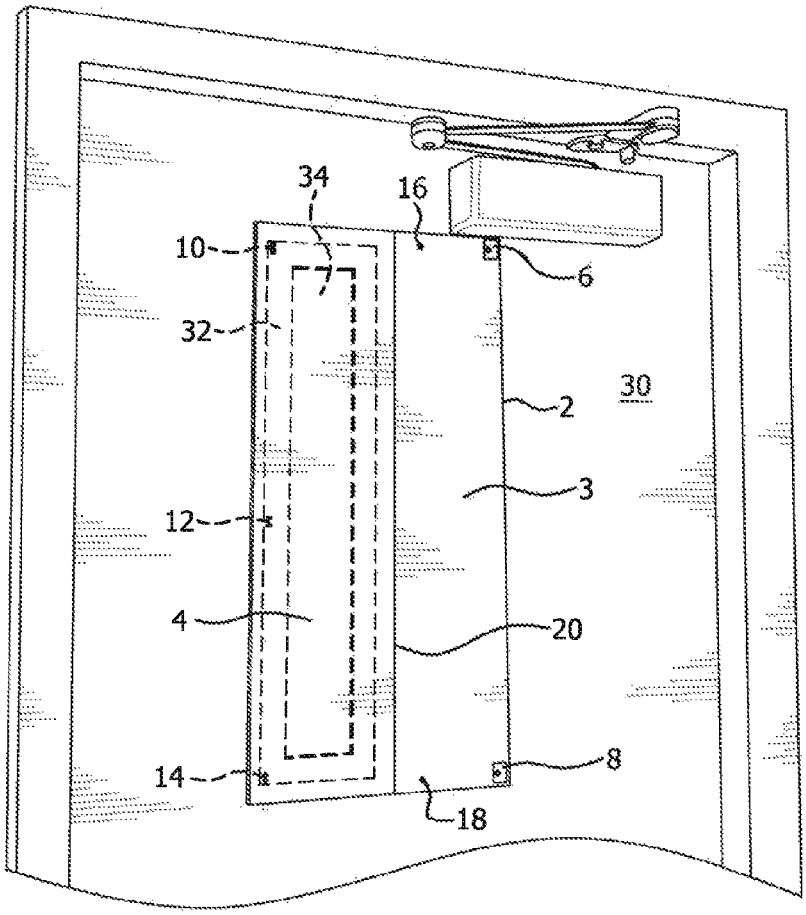
FIG. 5 shows the protective window shutter in place over the window.
Figure 6:
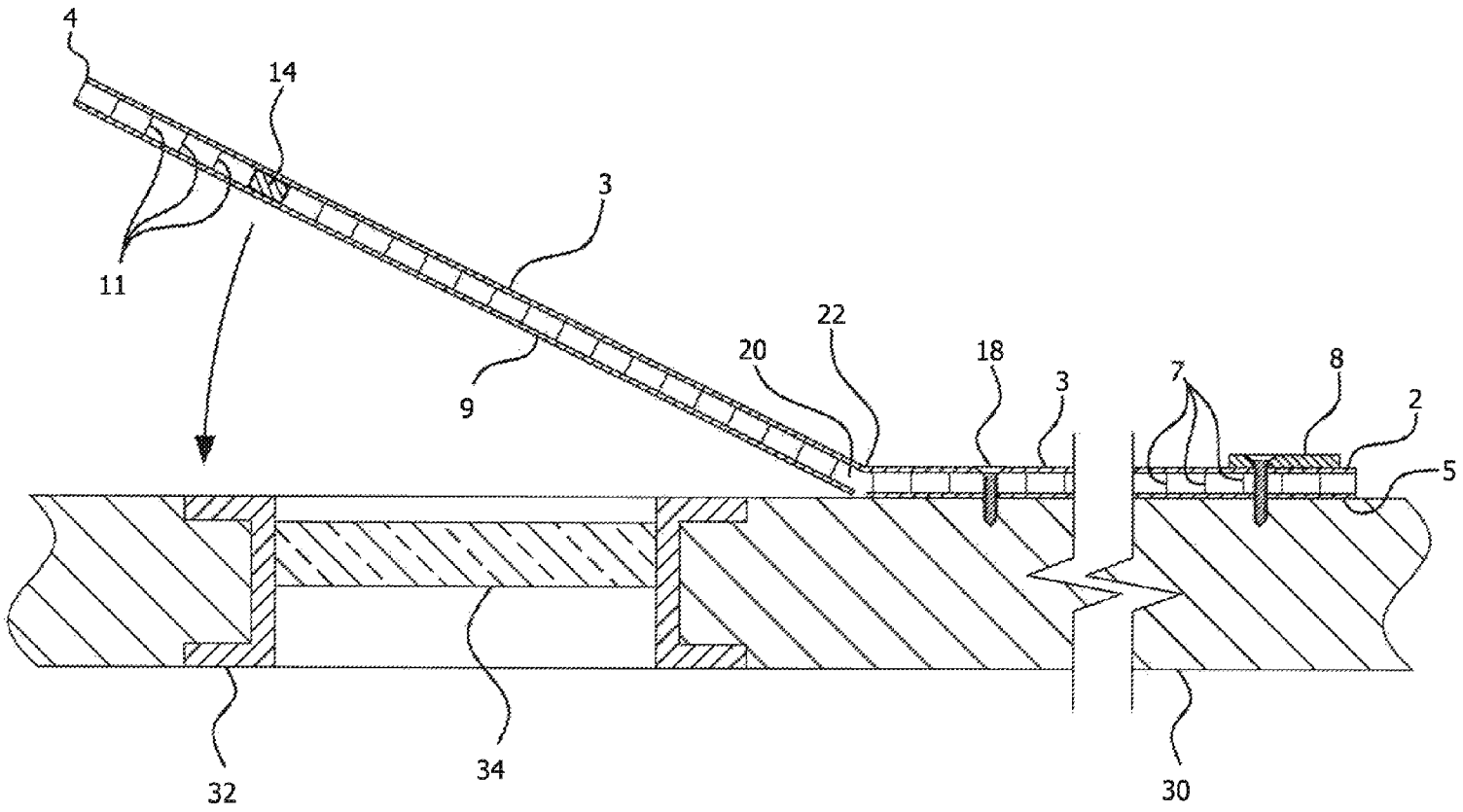
FIG. 6 is a cross-section of the protective window shutter taken from FIG. 2.

Second section 4 has elongated bottom layer comprising sheet 9 which extends the full length of the section. However, bottom sheet 9 is separate from bottom sheet 5 of first section 2, such that when second section 4 is folded onto the first section in the "window uncovered" position, see especially FIGS. 1 and 6, an elongated channel fold joint 20, extending the full length of the shutter from its top edge to its bottom edge, is formed between the sections, the bottom of the channel joint comprising a small portion 22 of single elongated top sheet 3 of the two sections. When sections 2 and 4 are fully unfolded in the "window cover" position, as seen in FIG. 5, the sections form the single, straight, rectangular-shaped shutter 1, with the two sections lying in the same vertical plane.

Like first section 2, a narrow elongated space separates elongated top sheet 3 and bottom sheet 9 of second section 4 and elongated, corrugated PVC strength ribs 11 extend the length of the section. Encased and secured within ribs 11, near the outboard edge of second section 4, are a plurality of strong magnets 10, 12, and 14. Additional magnets, in different arrangements, can be used as well.

In the "window uncovered" position, in which second section 4 is folded onto first section 2, as shown in FIG. 1, magnets 10 and 14 are attracted to strike plates 6 and 8 on the first section to maintain the sections in the folded position. In the "window covered" position, as shown in FIG. 5, magnets 10, 12, and 14 are attracted to metal window frame 32 around window 34, to maintain the fully opened shutter 1 over the window.

Installation of shutter 1 itself on door 30 is easily accomplished by the use of screws 16 and 18, which attach first section 2 to the door. Second section 4 is then simply folded over onto first section 2 in the "window uncovered" position, the attraction of strike plates 6 and 8 and magnets 10 and 14 maintaining shutter 1 in this position.

Figure 3:
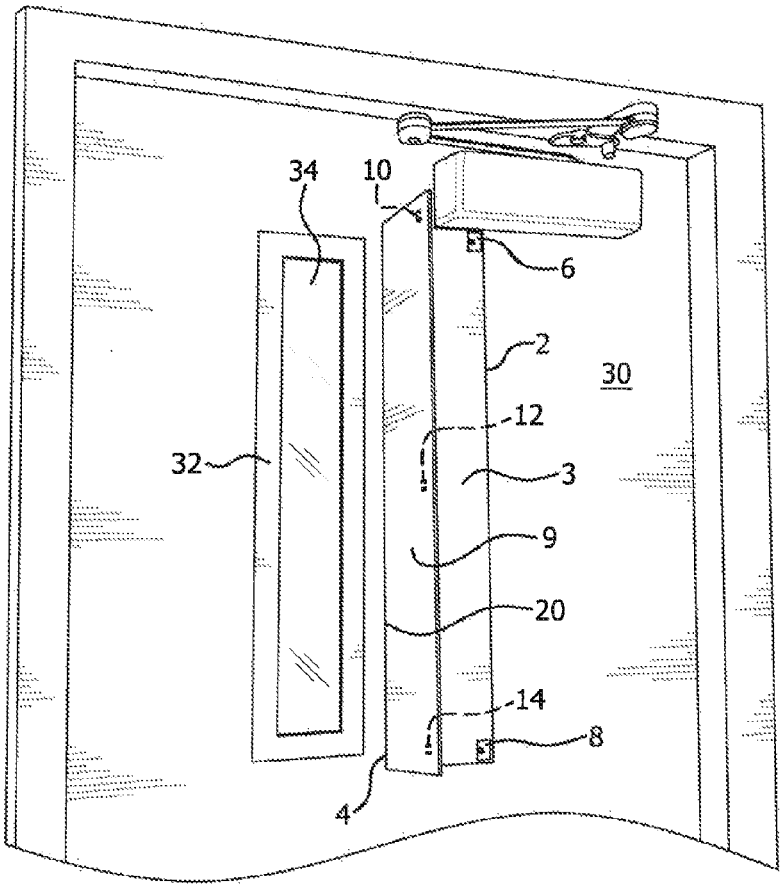
FIG. 3 shows the protective window shutter mounted on a door with a peek through framed window, illustrating the process of covering the window.
Figure 4:
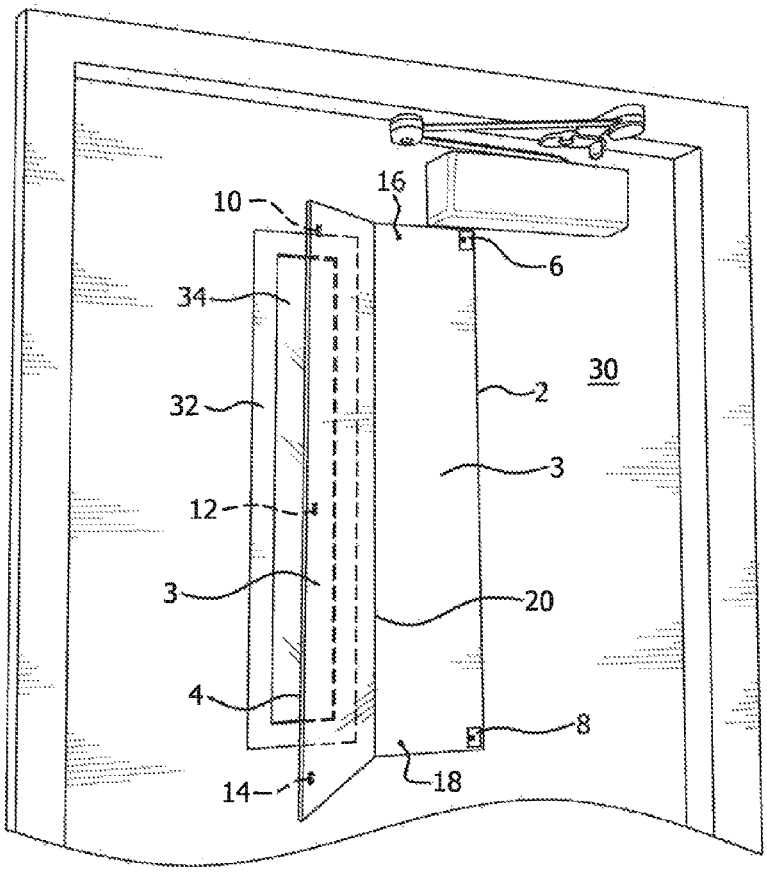
FIG. 4 shows the continuation of the window covering process shown in FIG. 3.

Shutter 1 is put into use by simply lifting second section 4 off first section 2 from the "window uncovered" position, and unfolding it, see FIGS. 3 and 4, so that the full width and length of the shutter covers window 34, see FIG. 5. Magnets 10, 12, and 14 in the second section 4 attach to window frame 32 to maintain shutter 1 in position over the window 34. Window 34 is uncovered by lifting second section 4 off window frame 32 and refolding it onto first section 2.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A protective window shutter system comprising:

a door with a window circumscribed by a metal plate, wherein the door is pivotable about a hinge axis between an open and closed position;

a shutter having a vertical length and a top edge and a bottom edge and further comprising:

a first shutter section having a vertical length and a horizontal width, said section being secured adjacent to the metal frame and having a top sheet extending the vertical length and the horizontal width of the section, and at least one metal strike plate secured to the top sheet;

a second shutter section having a vertical length and a horizontal width, said second section comprising a bottom sheet extending the vertical length of the second section and the horizontal width of the second section, said second section further comprising said top sheet which extends continuously and uninterrupted from the first section, said top sheet extending the vertical length of the second section and the horizontal width of the second section, and a space in the second section between the top sheet and the bottom sheet, the second section further comprising at least one magnet element secured within the space, said magnet element having a magnetic attraction; and a vertical joint between the first and second sections; said joint extending the vertical length of the shutter from the shutter top edge and the shutter bottom edge, wherein the vertical joint is parallel to the hinge axis;

whereby the shutter is rotatable from a first position in which the shutter is aligned and secured adjacent to and aloe the metal frame and the window is uncovered, the second section being folded onto the first section and attached to the first section by the magnetic attraction of said at least one magnet element to the at least one strike plate, and, in the first position the vertical joint comprises a channel extending the vertical length of the first and second sections from the top edge to the bottom edge of the shutter, the bottom of the channel comprising a portion of the top sheet, to a second position wherein the first and second sections are unfolded with the vertical joint therebetween and are located adjacent to and alongside each other in a common vertical plane, with the second section secured to and covering the window, the shutter being maintained in the second position by the magnetic attraction of the at least one magnet element to the metal frame.

2. The protective window shutter system as in claim 1 wherein the first section comprises a bottom sheet extending the horizontal width and the vertical length of the first section.

3. The protective window shutter system as in claim 1 further comprising a plurality of strike plates secured to the top sheet of the first section.

4. The protective window shutter system as in claim 1 further comprising a plurality of magnet elements located within the space of the second section.

5. The protective window shutter system as in claim 3 further comprising a plurality of magnet elements located within the space of the second section.

6. The protective window shutter system as in claim 1 wherein the space comprises a plurality of ribs extending the length of the second section and a plurality of magnet elements located within the ribs.

7. The protective window shutter system as in claim 2 wherein a space is formed between the top sheet and the bottom sheet of the first section, said space comprising a plurality of ribs extending the length of the first section.

* * * * *